US011779825B2

(12) United States Patent
Liu

(10) Patent No.: US 11,779,825 B2
(45) Date of Patent: Oct. 10, 2023

(54) MARTIAL ARTS TRAINING EQUIPMENT

(71) Applicant: Inez Yen Wei Liu, Taichung (TW)

(72) Inventor: Inez Yen Wei Liu, Taichung (TW)

( * ) Notice: Subject to any disclaimer, the term of this patent is extended or adjusted under 35 U.S.C. 154(b) by 46 days.

(21) Appl. No.: 17/571,749

(22) Filed: Jan. 10, 2022

(65) Prior Publication Data

US 2023/0218966 A1 Jul. 13, 2023

(51) Int. Cl.
*A63B 69/22* (2006.01)

(52) U.S. Cl.
CPC ..... *A63B 69/22* (2022.08); *A63B 2210/50* (2013.01); *A63B 2225/093* (2013.01)

(58) Field of Classification Search
CPC ..... A63B 69/22; A63B 69/20; A63B 69/222; A63B 69/224; A63B 69/24; A63B 69/244; A63B 69/28; A63B 69/30; A63B 2210/50; A63B 2225/093
See application file for complete search history.

(56) References Cited

U.S. PATENT DOCUMENTS 10,639,535 B2 * 5/2020 Hoover ..... A63B 69/004
10,751,597 B2 * 8/2020 Chen ..... A63B 71/023
11,065,521 B2 * 7/2021 Chen ..... A63B 69/20
11,471,739 B2 * 10/2022 Wu ..... A63B 69/004
2007/0167297 A1 * 7/2007 Stevenson ..... A63B 69/34 482/90
2014/0302969 A1 * 10/2014 Chen ..... A63B 69/203 482/90
2020/0155914 A1 * 5/2020 Hu ..... A63B 69/203
2021/0402275 A1 * 12/2021 Garcia ..... A63B 69/224

* cited by examiner

*Primary Examiner* — Megan Anderson

(74) *Attorney, Agent, or Firm* — Muncy, Geissler, Olds & Lowe, P.C.

(57) ABSTRACT

A martial arts training equipment includes a base mount, a post upwardly extending from the base mount, an elastic branch tube including a post sleeve sleeved onto the post, and at least one branch sleeve extending from the post sleeve, and at least one rod having an end inserted into or sleeved onto the at least one branch sleeve. Compared to the conventional Wooden Man Post, the martial arts training equipment is lightweight and convenient for carry and transportation, and the portion of the martial arts training equipment to be punched or kicked by a user is provided with satisfied buffering cushion and elasticity so as to prevent the user from uncomfortable feeling, and no bothersome noise will produce during training.

14 Claims, 3 Drawing Sheets

MARTIAL ARTS TRAINING EQUIPMENT

BACKGROUND OF THE INVENTION

1. Field of the Invention

The present invention relates generally to a tool for martial arts and more particularly, to a martial arts training equipment.

2. Description of the Related Art

Wing Chun is a style of Chinese martial arts. Bruce Lee introduces Wing Chun on the international stage, and Wing Chun has become more well-known due to the success of the Ip Man movie series. Wooden Man Post, which is also known as Wing Chun Wooden Striking Dummy, is the most important training equipment for practicing Wing Chun. Conventionally, the Wooden Man Post is made of wood and provided with dummy arms and legs having very limited activity flexibility. In training, the Wooden Man Post is simulated as an enemy to be punched and/or kicked by a user, such that the user may try to harden his/her hands, forearms, legs, etc. and to build the mobility of the whole body and the flexibility of the footwork.

It is known that the conventional Wooden Man Post is quite heavy and can only be usually placed in the gymnasium for being used by martial arts practitioners. Due to the heavy weight, the conventional Wooden Man Post is quite inconvenient in carry and transportation. If the Wooden Man Post needs to be moved to outdoor for teaching or practice, the moving task will be very laborious. In another aspect, in recent years, more and more women or children have participated in the exercises of the martial arts. The wooden dummy arms and legs of the conventional Wooden Man Post are quite hard and less flexibility, so that the user will always feel pain when punching or kicking the Wooden Man Post. Therefore, there are not a few people who are deterred from practicing martial arts. In still another aspect, if the conventional Wooden Man Post is installed in a living room of an ordinary apartment, the sound made by punching and/or kicking the dummy arms and legs will be quite loud, which may bother neighbors. Further, the positions and orientations of the dummy arms and legs of the conventional Wooden Man Post are usually fixed and not adjustable, which deteriorates the possibility of variations in practice. Furthermore, making conventional Wooden Man Post will consume a lot of wood, which is not environmentally friendly. Therefore, it is necessary to develop a lighter, more environmentally friendly and adjustable training equipment to make practicing traditional martial arts more convenient and accessible.

SUMMARY OF THE INVENTION

The present invention has been accomplished in view of the above-noted circumstances. It is an objective of the present invention to provide a martial arts training equipment, which is lightweight and convenient in carry and transportation compared to the conventional Wooden Man Post.

Another objective of the present invention is to provide a martial arts training equipment, which provides certain buffering cushion and flexibility at the part to be punched and/or kicked by a user, thereby preventing the user from being deterred from practicing martial arts, and avoiding laud bothersome noise in use.

Still another objective of the present invention is to provide a martial arts training equipment, which enables to adjust the overall height and the orientation of the dummy arm in accordance with the user's need and is needless to use wood so as to achieve environmental protection.

To attain at least one of the above objectives, the present invention provides a martial arts training equipment comprising a base mount, a post, an elastic branch tube, and at least one rod. The post upwardly extends from the base mount. The elastic branch tube comprises a post sleeve sleeved onto the post, and at least one branch sleeve extending from the post sleeve. The rod has an end connected with the branch sleeve in a sleeve-connecting manner, i.e., the end of the rod is inserted into or sleeved onto the branch sleeve. As a result, compared to the conventional Wooden Man Post, the martial arts training equipment of the present invention is lightweight and convenient in carry and transportation, and the part to be hit or contacted by a user is provided with certain buffering cushion and flexibility to prevent the user from being deterred from practicing martial arts, and the martial arts training equipment will not produce laud, bothersome noise in use.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
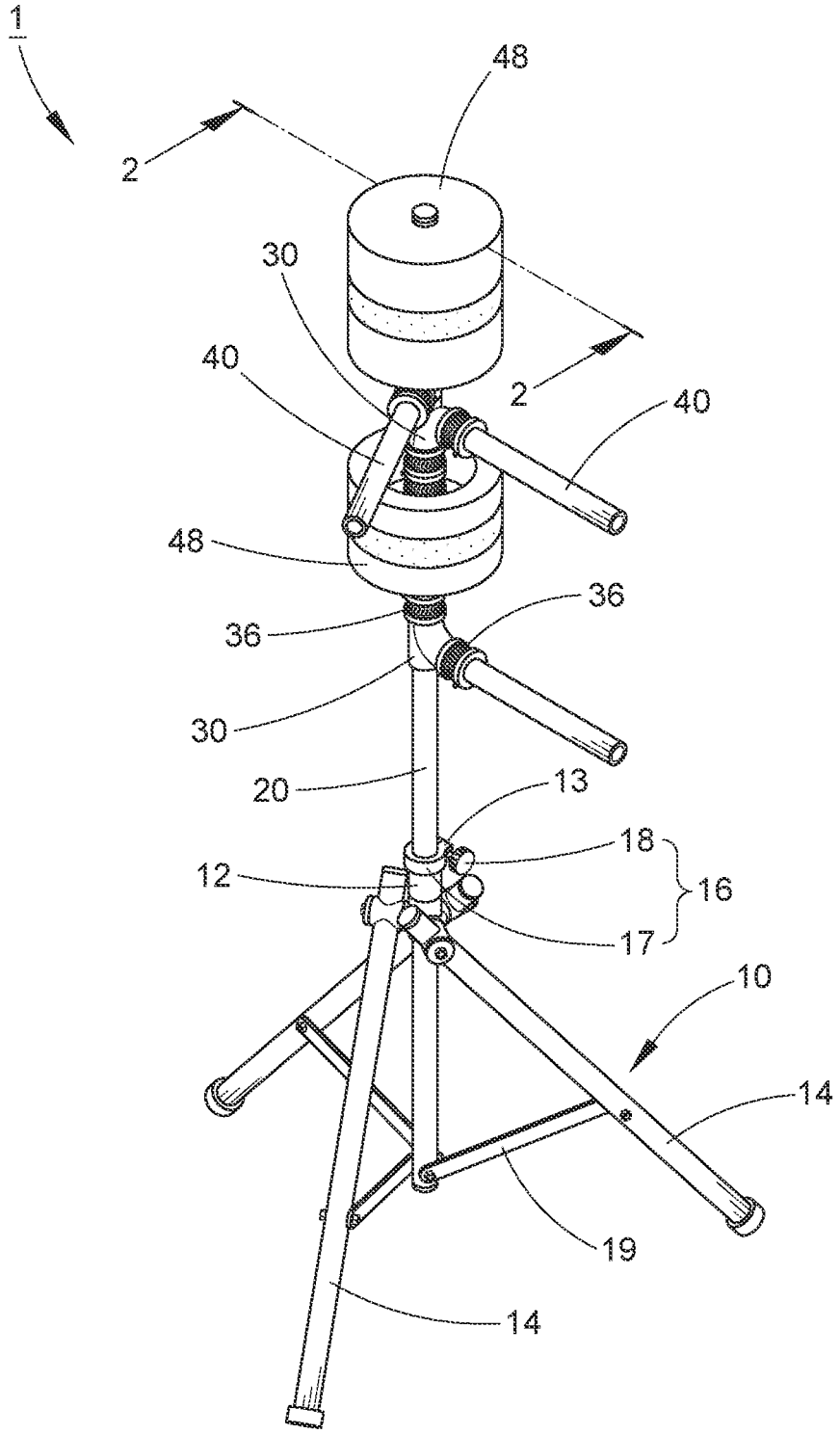
FIG. 1 is a perspective view of a martial arts training equipment according to an embodiment of the present invention.
Figure 2:
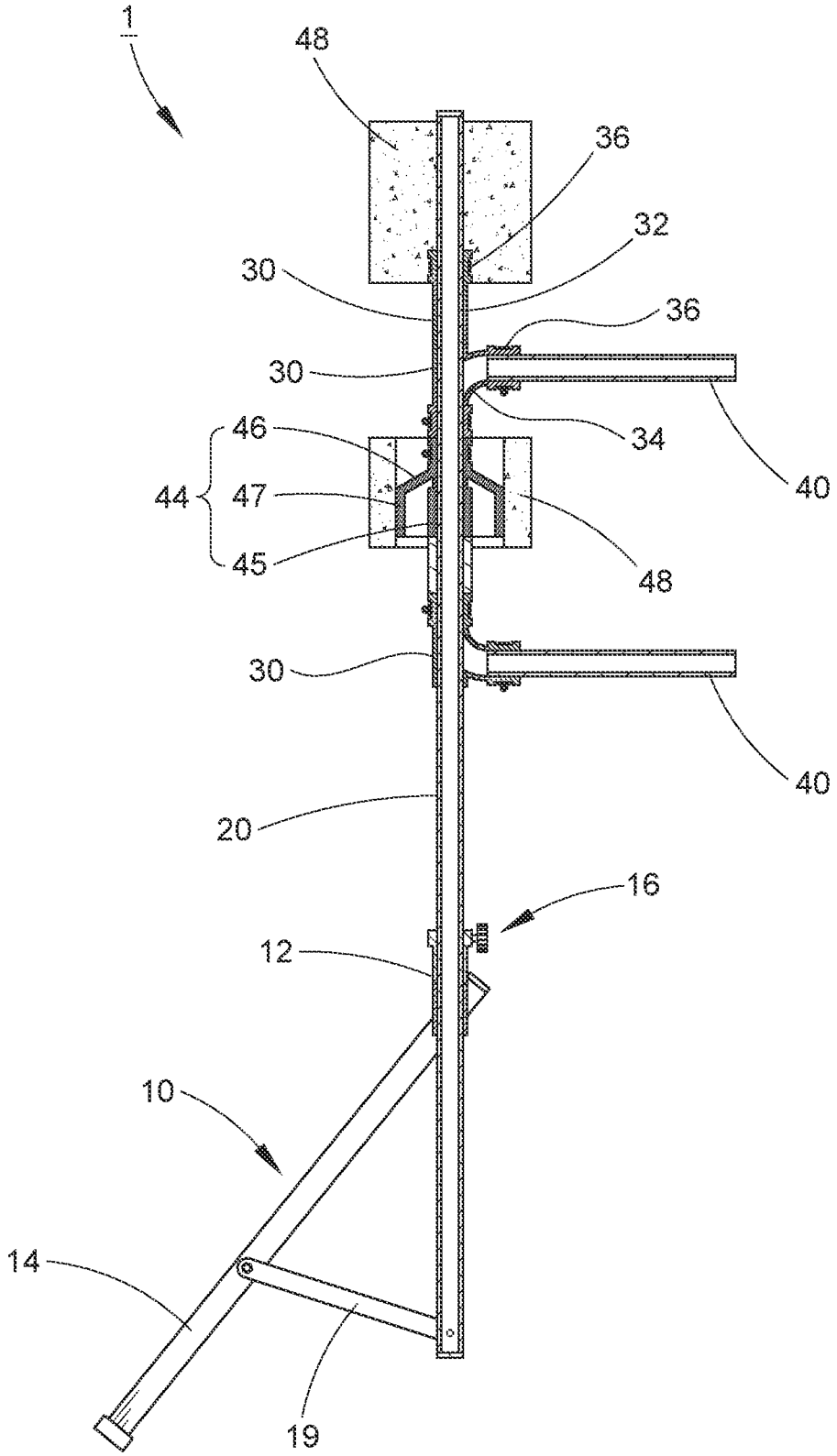
FIG. 2 is a sectional view taken along line 2-2 of FIG. 1.
Figure 3:
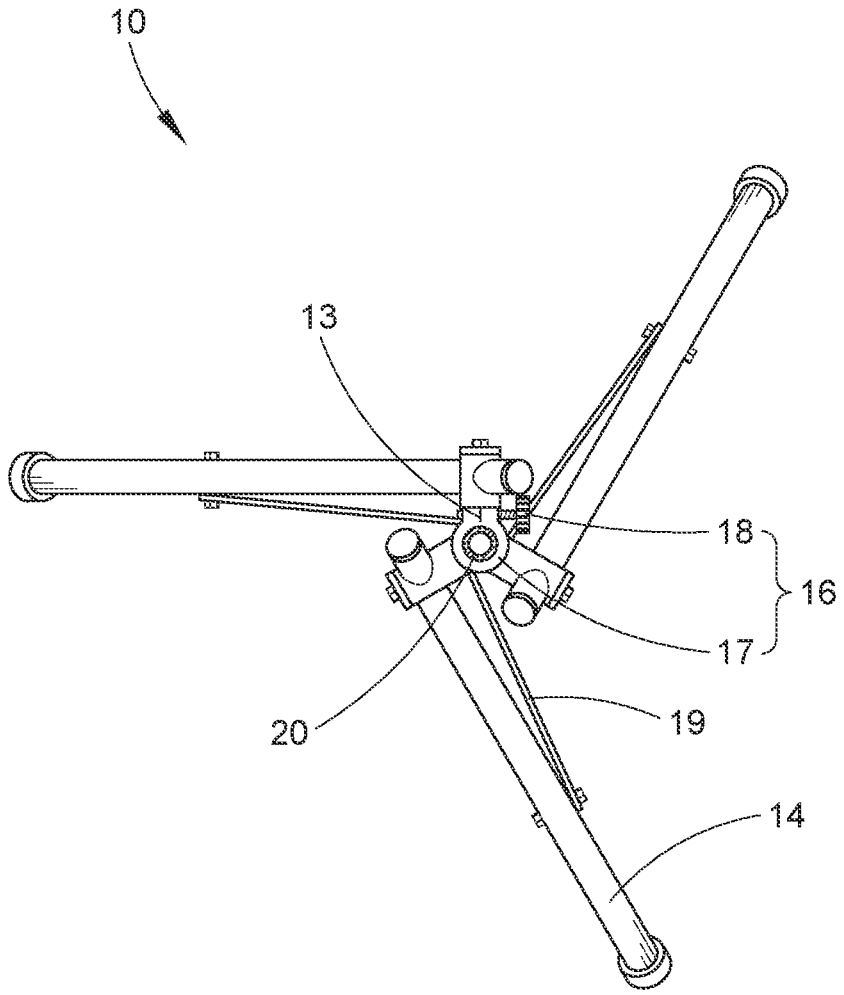
FIG. 3 is a top plan view of a base mount of the martial arts training equipment of the embodiment of the present invention.

The structure and technical features of the present invention will be detailedly described hereunder by an embodiment and accompany drawings. As shown in FIGS. 1-3, a martial arts training equipment 1 provided in accordance with an embodiment of the present invention comprises a base mount 10, a post 20, three branch tubes 30, three rods 40, a two-layered tube 44, and two cushion cylinders 48.

The base mount 10 comprises a positioning sleeve 12, through which the post 20 is slidably inserted, three legs 14 pivotally connected with the positioning sleeve 12, and a positioning unit 16 for fixedly and releasably fastening the post 20 and the positioning sleeve 12 together. The positioning sleeve 12 is provided at a top end portion thereof with a cut slit 13, such that the caliber of the top end portion of the positioning sleeve 12 can be changed within a certain range. The positioning unit 16 includes a C-shaped clamping portion 17 at the top end portion of the positioning sleeve 12, and a bolt 18 penetrating through the clamping portion 17 for adjusting the calibers of the clamping portion 17 and the top end portion of the positioning sleeve 12. The legs 14 can stand on the ground to provide a stable support. In another embodiment, four or more legs may be used, and suction pads may be provided at the bottom ends of the legs 14 to enhance the stability. In still another embodiment, the base mount 10 may be realized as a circular disc or a rectangular plate. The structure of the base mount 10 is not limited to the one disclosed in this embodiment as long as it can provide a stable support to the members that are mounted thereon.

The post 20 extends upwardly from the base mount 10. Specifically, the post 20 is inserted through the positioning sleeve 12. When the bolt 18 is loosened from the clamping portion 17, the post 20 can be forced to move relative to the base mount 10 up and down to adjust the overall height of the martial arts training equipment 1 in accordance with the user's need. If the bolt 18 is tightened up to force the clamping portion 17 to clamp, the post 20 can be clamped by the positioning sleeve 12 of the base mount 10 to keep in a desired position. To enable the up-and-down motion of the post 20 to synchronously drive the three legs 14 to extend or retract, the base mount 10 may further comprise three links 19 each having two ends pivotally connected with the post 20 and one of the legs 14, respectively. As a result, when the post 20 is downwardly moved from the state shown in FIG. 1, the legs 14 will be retracted relative to each other, i.e., folded toward the post 20. However, these links 19 may be omitted. In this case, the open angles of the three legs 14 will not be changed when the post 20 is moved upwardly or downwardly.

The elastic branch tubes 30 are made by rubber or other elastic materials and each comprise a post sleeve 32 sleeved onto the post 20, and a branch sleeve 34 laterally and outwardly extending from the post sleeve 32. To firmly connect the branch tube 30 with the post 20, a retaining member 36 may be provided to be sleeved onto the post sleeve 32. The retaining member 36 may be made by stainless steel or plastic material and has an adjustable caliber for firmly holding the post sleeve 32 with the post 20. The orientations and positions of the branch tubes 30 can be adjusted in accordance with the actual needs so as to change the extending directions and elevational heights of the branch sleeves 34. In another embodiment of the present application, the branch tube 30 may have two or more branch sleeves 34, and the post sleeves 32 may be adhered or anchored with the post 20.

The rods 40 each have an end inserted into the branch sleeve 34 of one branch tube 30. To firmly connect the rod 40 with the associated branch sleeve 34, a retaining member 36 may be provided to be sleeved onto a connection portion where the rod 40 is inserted into and thus connected with its associated branch sleeve 34. The two rods 40 located at the upper part of the martial arts training equipment 1, namely the two upper rods 40, may serve as two dummy arms of the so-called Wooden Man Post. The included angle between the two upper rods 40 may be changed by adjusting the orientations of the associated two branch tubes 30. In another embodiment, one single branch tube 30 having two branch sleeves 34 may substitute for the two upper branch tubes 30, and in this case the two branch sleeves 34 of the single branch tube 30 are arranged in a coplanar manner with a predetermined included angle, such as 45 degrees, therebetween. In this way, the martial arts training equipment 1 may have a simpler structure. In this embodiment, the rod 40 is a polyvinyl chloride tube (PVC tube), which is lightweight and has satisfied elasticity. Further, the branch tube 30 is also provided with satisfied elasticity or flexibility. When the user's hand or forearm hits the rods 40, the user may feel a real combat with a real man with less pain and discomfort, and no bothersome bumping noise may generate. However, in another embodiment, the rod 40 may be made by other material or have a solid core, and the rod 40 may be adhered or anchored with its associated branch sleeve 34.

The two-layered tube 44 comprises an inner tube member 45 sleeved onto the post 20, a cone member 46 extending outwardly from the inner tube member 45, and an outer tube member 47 extending downwardly from an outer edge of the cone member 46. To firmly connect the inner tube member 45 with the post 20, a retaining member 36 may also be provided to be sleeved onto the outer periphery of the inner tube member 45, or the inner tube member 45 may be adhered or anchored with the post 20.

The two cushion cylinders 48 are made of foam materials and shaped like a cylindrical open barrel. The cushion cylinder 48 located at an upper part of the martial arts training equipment 1, namely the upper cushion cylinder 48, is directly encapsulated around the post 20 and simulated as the head of a man for providing a buffering cushion effect when the user hits it. The lower cushion cylinder 48, i.e., the one below the upper cushion cylinder, is sleeved onto the outer tube member 47 of the two-layered tube 44 in such a way that the two-layered tube 44 is disposed between the lower cushion cylinder 48 and the post 20, and the outer tube member 47 is abutted against an inner periphery of the lower cushion cylinder 48. The lower cushion cylinder 48 is simulated as the chest or abdomen of a man. Since a space is left between the inner tube member 45 and the outer tube member 47, the lower cushion cylinder 48 can provide more buffering space and better buffering effect.

Because the martial arts training equipment 1 of the present invention are constructed by metal, rubber or plastic tubes and the foam-made cushion cylinders 48, the martial arts training equipment 1 has a simple, lightweight structure, thereby facilitating carry and transportation thereof. Further, the three legs 14 can be folded toward the post 20 to minimize the occupied space. The rubber branch tubes 30 are used to simulate the elasticity of joints of human body, such that the martial arts training equipment 1 can provide a sense of touch more like a human being than the convention Wooden Man Post can, and will not generate bothersome bumping noise when it is in use. Furthermore, the elevational height of the post 20 can be adjusted in accordance with the user's need, and the positions and orientations of the branch tubes 30 and the two-layered tube 44 can be easily adjusted by loosening the retaining members 36. As a result, the martial arts training equipment 1 of the present invention provides a flexibility of use greater than that of the conventional Wooden Man Post. Moreover, no wood is required to manufacture the martial arts training equipment 1 of the present invention, achieving the objective of environmental protection.

Based on the technical features of the present invention, various modifications to the martial arts training equipment 1 may be made. For example, the post 20 may be configured as being directly and upwardly extended from a circle-disc base mount 10 and being provided with no lifting function. Further, the positioning unit 16 may be configured as being other structure having a tightening function, such as a bolt using an end thereof to abut against the post 20. In the above-illustrated embodiment, the rod 40 is inserted into the branch sleeve 34; however, the rod 40 may be configured as being sleeved onto the outer periphery of the branch sleeve 34. That is, the rod 40 and the branch sleeve 34 are connected with each other in a sleeve-connecting manner, i.e., one is inserted into or sleeved onto the other. To strength the stability of the martial arts training equipment 1, weights may be provided at the links 19 of the base mount 10. Such variations are not to be regarded as a departure from the spirit and scope of the invention, and all such modifications as would be obvious to one skilled in the art are intended to be included within the scope of the following claims.

What is claimed is:

1. A martial arts training equipment, comprising:

a base mount;

a post upwardly extending from the base mount;

an elastic branch tube comprising a post sleeve sleeved onto the post, and at least one branch sleeve extending from the post sleeve; and at least one rod having an end connected with the at least one branch sleeve in a sleeve-connecting manner.

2. The martial arts training equipment as claimed in claim 1, wherein the post extends from the base mount in a way that the post is upwardly and downwardly moveable relative to the base mount.

3. The martial arts training equipment as claimed in claim 2, wherein the base mount comprises a positioning sleeve, through which the post is slidably inserted.

4. The martial arts training equipment as claimed in claim 3, wherein the base mount comprises a positioning unit to fasten the post and the positioning sleeve together.

5. The martial arts training equipment as claimed in claim 4, wherein the positioning unit comprises a clamping portion and a bolt penetrating through the clamping portion to adjust a caliber of the clamping portion.

6. The martial arts training equipment as claimed in claim 3, wherein the base mount comprises three legs pivotally connected with the positioning sleeve.

7. The martial arts training equipment as claimed in claim 6, wherein the base mount comprises three links; each of the three links has one end pivotally connected with the post and one end pivotally connected with one of the three legs, respectively.

8. The martial arts training equipment as claimed in claim 1, wherein the base mount comprises a positioning sleeve, through which the post is slidably inserted.

9. The martial arts training equipment as claimed in claim 8, wherein the base mount comprises a positioning unit to fasten the post and the positioning sleeve together.

10. The martial arts training equipment as claimed in claim 9, wherein the positioning unit comprises a clamping portion and a bolt penetrating through the clamping portion to adjust a caliber of the clamping portion.

11. The martial arts training equipment as claimed in claim 8, wherein the base mount comprises three legs pivotally connected with the positioning sleeve.

12. The martial arts training equipment as claimed in claim 11, wherein the base mount comprises three links; each of the three links has one end pivotally connected with the post and one end pivotally connected with one of the three legs, respectively.

13. The martial arts training equipment as claimed in claim 1, further comprising a cushion cylinder sleeved onto the post.

14. The martial arts training equipment as claimed in claim 13, further comprising a two-layered tube disposed between the cushion cylinder and the post; the two-layered tube comprises an inner tube member sleeved onto the post, a cone member extending from the inner tube member, and an outer tube member extending from the cone member and being abutted against an inner periphery of the cushion cylinder.

* * * * *